United States Patent [19]

Simpson

[11] Patent Number: 5,030,071

[45] Date of Patent: Jul. 9, 1991

[54] ROLLER VAN MOTOR WITH FLUID BIASSED ROLLER

[76] Inventor: Neil A. A. Simpson, Burn of Daff Farm, Downies, Portlethen, Aberdeen AB1 4QX, Scotland

[21] Appl. No.: 449,375

[22] Filed: Dec. 6, 1989

Related U.S. Application Data

[63] Continuation of Ser. No. 155,347, Feb. 12, 1988, abandoned.

[30] Foreign Application Priority Data

Feb. 14, 1987 [GB] United Kingdom ..... 8703498

[51] Int. Cl.[5] ..... F03C 2/22

[52] U.S. Cl. ..... 418/13; 418/39; 418/213; 418/225; 418/268; 418/269; 175/107

[58] Field of Search ..... 418/13, 212, 213, 225, 418/268, 269, 39, 258, 93, 267; 175/107

[56] References Cited

U.S. PATENT DOCUMENTS

| | | | |
|---|---|---|---|
| 345,885 | 7/1886 | Colebrook | 418/225 |
| 994,400 | 6/1911 | Holt | 418/93 |
| 1,053,767 | 2/1913 | Allan | 418/213 |
| 2,484,993 | 10/1949 | Gruber | 418/258 |
| 2,725,013 | 11/1955 | Vlachos | 418/225 |
| 2,826,179 | 3/1958 | Klessig et al. | 418/225 |
| 2,949,860 | 8/1960 | Stockton | 418/269 |
| 3,366,069 | 1/1968 | Krueger | 418/225 |
| 3,373,693 | 3/1968 | McKittrick | 418/13 |
| 4,105,377 | 8/1978 | Mayall | 418/225 |

FOREIGN PATENT DOCUMENTS

| | | | |
|---|---|---|---|
| 411482 | 8/1945 | Italy | 418/225 |
| 57-126591 | 8/1982 | Japan | 418/39 |

*Primary Examiner*—John J. Vrablik

[57] ABSTRACT

A roller vane motor as described, the motor having a stator with a generally cylindrical chamber provided with fluid inlet and outlet means. A rotor is provided in the chamber to be rotatable therein, the rotor having a slot to receive a roller which forms a seal between the rotor and said chamber. The roller is urged into the sealing condition by means of drive fluid flowing behind the roller. A twin-roller version is also described as is a motor assembly made up of a number of vane motors arranged in line.

6 Claims, 6 Drawing Sheets

57
50
22
21
30
26
8
9
22a
22b
22c
22d
22e
22f
22g
40a
40b
40c
40d
40e
40f
43b
43c
43d
43e
43f
43g
6a
6b
6c
6d
6e
6f
7a
7b
7c
7d
7e
7f
38a
38b
38c
38d
38e
38f
39a
39b
39c
39d
39e
39f
41a
41b
41c
41d
41e
41f
44a
44b
44c
44d
44e
44f

ROLLER VAN MOTOR WITH FLUID BIASSED ROLLER

This application is a continuation, of application Ser. No. 07/155,347, filed 2/12/88, abandoned.

This invention relates to a roller vane motor.

The invention has particular application in the driving of Polycrystaline Diamond Compacts or Polycrystaline Diamond Cutters hereinafter referred to as P.D.C. drill bits.

BACKGROUND OF THE INVENTION

To drive P.D.C. drill bits it is known to use a motor located on the drill string which is driven by the drilling mud that is pumped through the drill string.

Turbine motors have been used for this purpose though they operate at high speed producing a relatively low torque whereas P.D.C. requires a low speed drive at a relatively high torque.

Mono type positive displacement motors (P.D.M.s) are also used for this purpose and offer the advantages of ease of downhole monitoring and simplicity of operation. However, this form of motor relies upon the use of elastomer material in the stator which limits the operational temperature and pressure thus lowering the total output and efficiency of the motors which are also relatively expensive to manufacture and maintain.

Motors which operate in a similar manner to roller vane type pumps have not been used previously in this application, despite the simplicity and robustness of the design. The reason for this is that motors of this type require a relatively large diameter in relation to power output.

A reduction in roller size would reduce the diameter of such a motor but this would also lead to a large reduction in the volumetric efficiency and the greater fluid velocity would lead to increased erosion of the motor. In addition, as roller vane type machines rely heavily on centrifugal force to hold the rollers in sealing contact with the inner wall of the stator, motors of this type would be unable to start from rest unless specific means were included, such as, for example springs, to urge the vanes radially outwards.

In all hydraulic vane motors/pumps the pumping effect provided behind the rollers/blade is a major disadvantage. In the case of this invention, where part of the roller effectively creates a part of the internal bore of the rotor, this pumping effect is eliminated and the hydraulic forces on the roller become an advantage rather than a disadvantage.

OBJECTS OF THE INVENTION

It is an object of this invention to obviate or mitigate the above disadvantages.

SUMMARY OF THE INVENTION

According to the present invention there is provided a roller vane motor comprising a stator provided with a generally cylindrical chamber having drive fluid inlet and outlet openings, a rotor in the chamber being rotatable on an axis parallel to the axis of the chamber, and a roller disposed in the housing and radially movable to form a seal between the rotor and the housing, the axis of the roller being substantially parallel to the axes of the rotor and the chamber, a portion of the drive fluid being arranged to flow to urge the roller in a direction to form said seal.

Further according to the present invention there is provided a roller vane motor comprising a stator provided with a generally cylindrical chamber having drive fluid inlet and outlet openings, a rotor in the chamber being rotatable on an axis parallel to, but offset from, the axis of the chamber, and a roller disposed in a slot formed in the rotor, the axis of the rotor being substantially parallel to the axes of the rotor and the chamber, wherein a portion of the drive fluid flows through a cavity formed between the rear wall of the slot and the roller face.

Preferably, means are provided at the fluid outlet from the cavity such that the flow of fluid through the cavity is restricted and may be altered if desired from full flow to zero flow.

Preferably also, the drive fluid inlet and outlet are located at opposite end portions of the chamber.

Alternatively, the drive fluid inlet and outlet may be side entry ports located along part or the whole of the chamber length on either side of the point of contact of the rotor and the chamber.

When the motor is located in a drill string and is being utilised to drive a drill bit, the drive fluid inlet may be located at an upper end portion of the chamber to receive drilling mud which is pumped down through the drill string.

In one embodiment more than one motor may be arranged in line, the rotors of the motors being formed on a common shaft but the rotors and the body members being offset to one another such that at least one of the rollers is being driven at all times.

BRIEF DESCRIPTION OF THE DRAWINGS

Embodiments of the present invention will now be described, by way of example, with reference to the accompanying drawings, in which.

DESCRIPTION OF PREFERRED EMBODIMENTS

Figure 1:
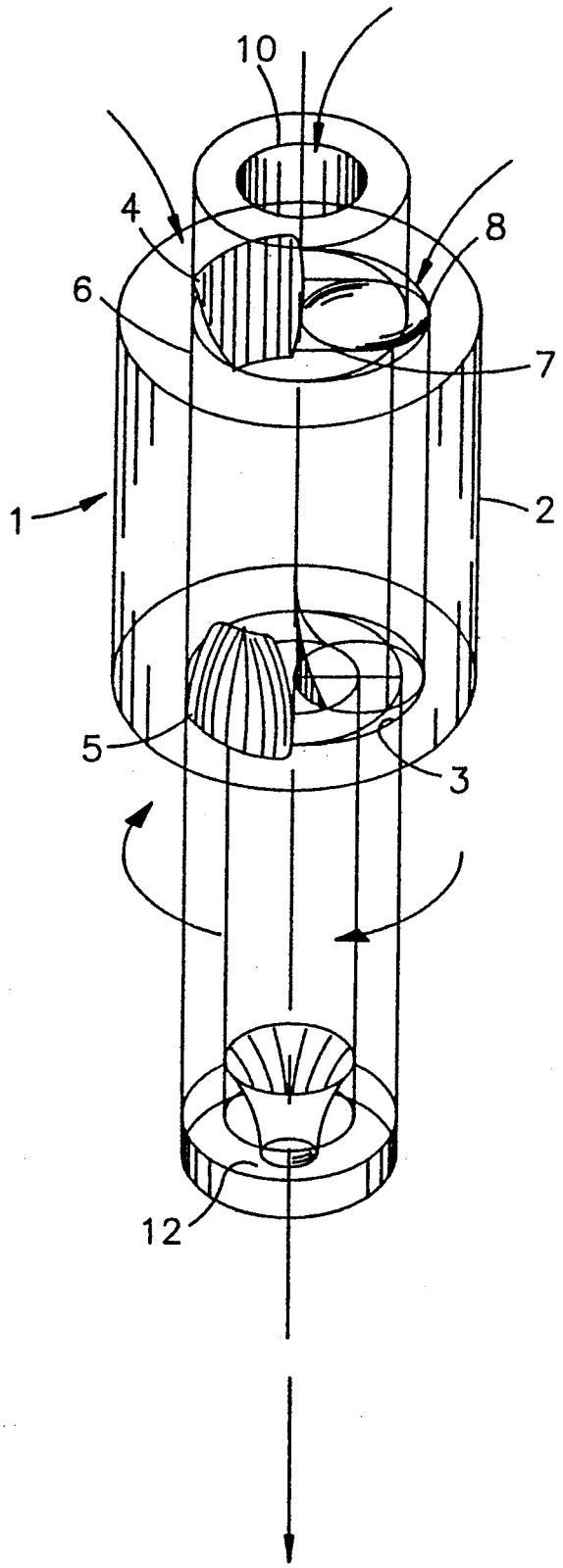
FIG. 1 is a perspective view from above of a single unit roller vane motor in accordance with the present invention.
Figure 3:
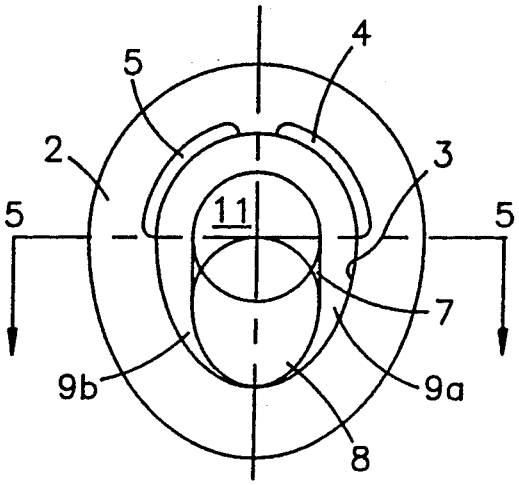
FIGS. 2 and 3 are plan views of the motor of FIG. 1.
Figure 2:
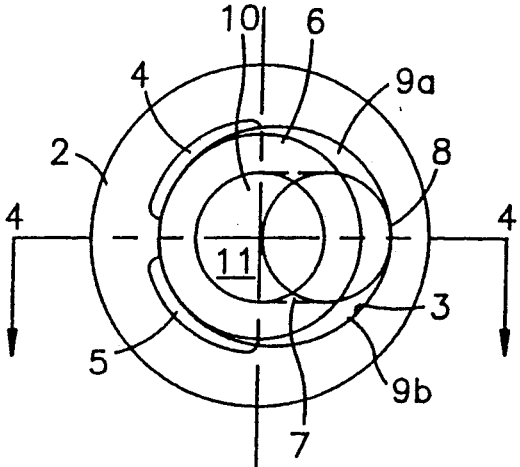
Figure 5:
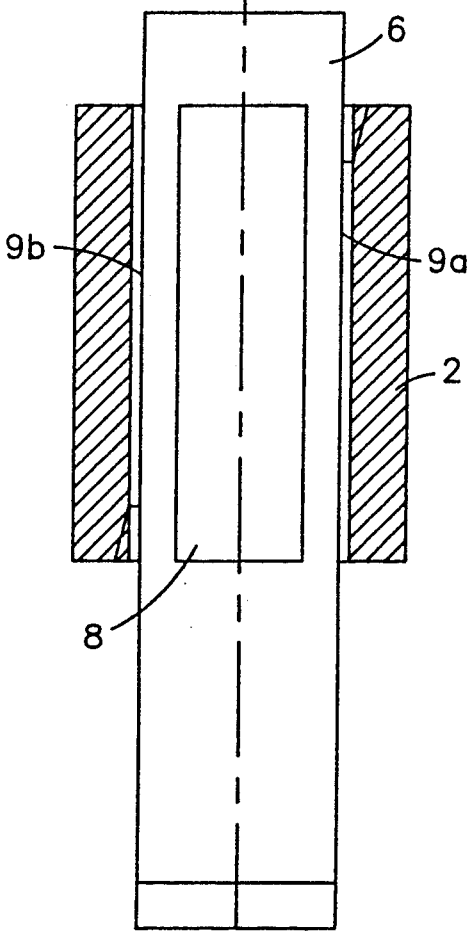
FIG. 5 is a part cut-away front view in elevation of the motor of FIG. 1.
Figure 4:
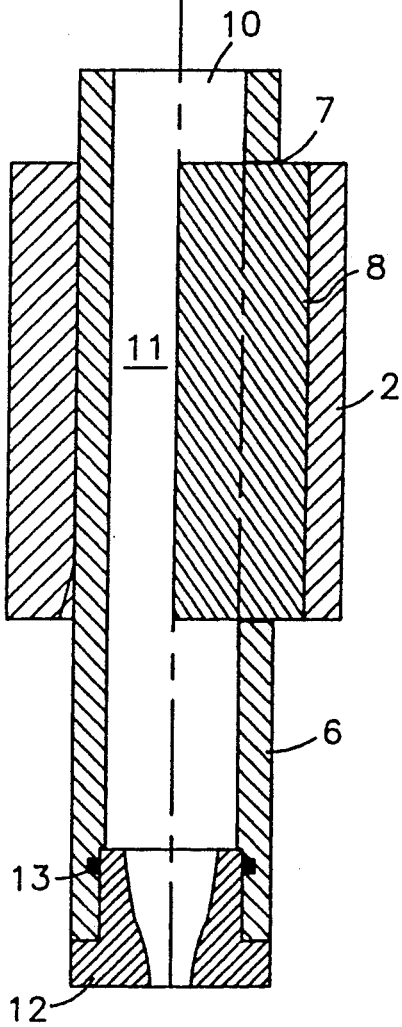
FIG. 4 is a sectional side view in elevation on line IV—IV of FIG. 2.

Referring to FIGS. 1 to 5 of the drawings, a roller vane motor is formed of a single roller unit, shown generally at 1, which includes a stator 2 provided with an offset cylindrical chamber 3 having a drive fluid inlet 4 at an upper end and a drive fluid outlet 5 at a lower end. A rotor 6 is located in the chamber 3 on an axis parallel to, but offset from, the axis of the chamber 3.

A radial slot 7 is formed in the rotor 6 and extends to the centre of the rotor 6. A roller 8 is disposed in the slot 7 for radial movement therein, the axis of the roller 8 being parallel to the axes of the rotor 6 and the chamber 3.

The drive fluid inlet 4 and outlet 5 are offset and are located on either side of the line of sealing contact of the rotor 6 and the chamber wall.

Fluid introduced through the inlet 4 flows into the cavity 9*a* formed between the rotor 6, the wall of the chamber 3, and a face of the roller 8, the ends of the chamber 9 being sealed by bushes (omitted from the drawings for clarity) located on either end of the stator 2.

The pressure of the fluid acting on the roller 8 turns the rotor 6 forcing fluid from the chamber 9*b*, on the opposite side of the roller 8, out of the outlet 5. Inertia carries the rotor 6 past the "dead" area, in which the roller 8 is positioned such that the inlet 4 and outlet 5 are in direct communication, until the roller 8 has passed the line of contact between the rotor 6 and the wall of the chamber 3 and is again subject to force from the incoming fluid.

The roller 8 is maintained in contact with the wall of the chamber 3 by the pressure of drive fluid acting on the rear face of the roller 8. The fluid is directed through a cylindrical inlet 10, which extends from the stator 2, into a cavity 11 formed between the rear wall of the slot 7 and the opposing face of the roller 8. The fluid leaves the cavity 11 through a restricting nozzle 12 screwed to the end of the lower portion of the rotor 6, which extends beyond the stator 2. An O-ring seal 13 is provided in an annular groove on the rotor 6 above the screw thread of the nozzle 12.

If desired, the nozzle 12 may be replaced by a nozzle of different internal diameter so that a different proportion of the drive fluid flows through the rotor 6 and a different proportion of the fluid is directed to drive the motor, thus altering the output of the motor and the pressure of the drive fluid downstream of the unit 1.

Figure 6:
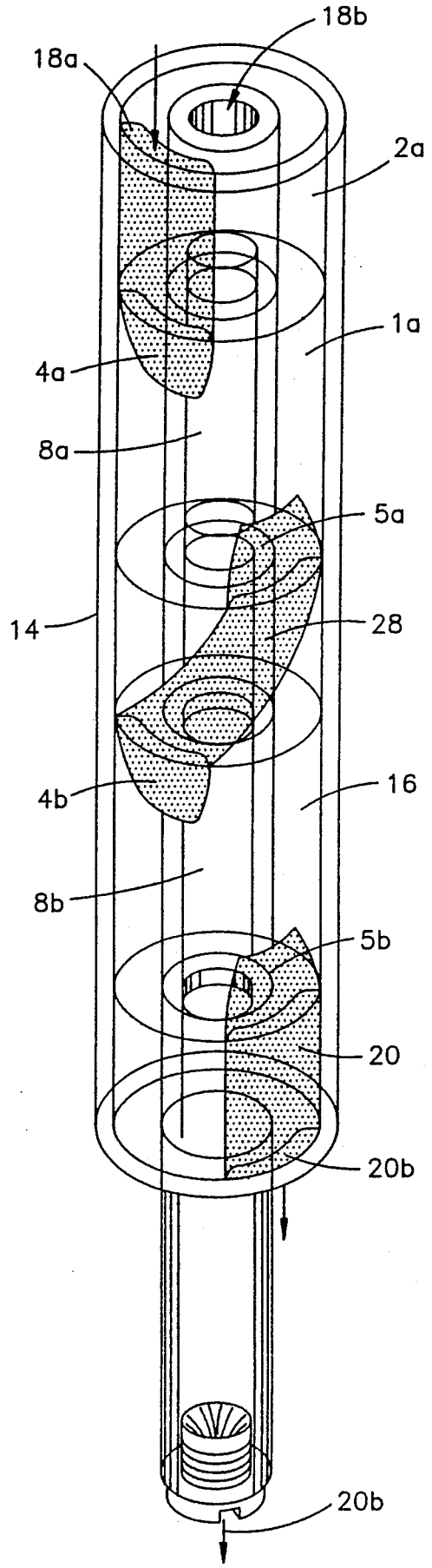
FIG. 6 is a perspective view from above of a two unit roller vane motor in accordance with a further embodiment of the present invention, the units being powered in series.
Figures 7, 8, 9, 10A, 10B, 10C, 10D, 10E, 10F, 10G, 11A, 11B, 11C, 11D, 11E, 11F:
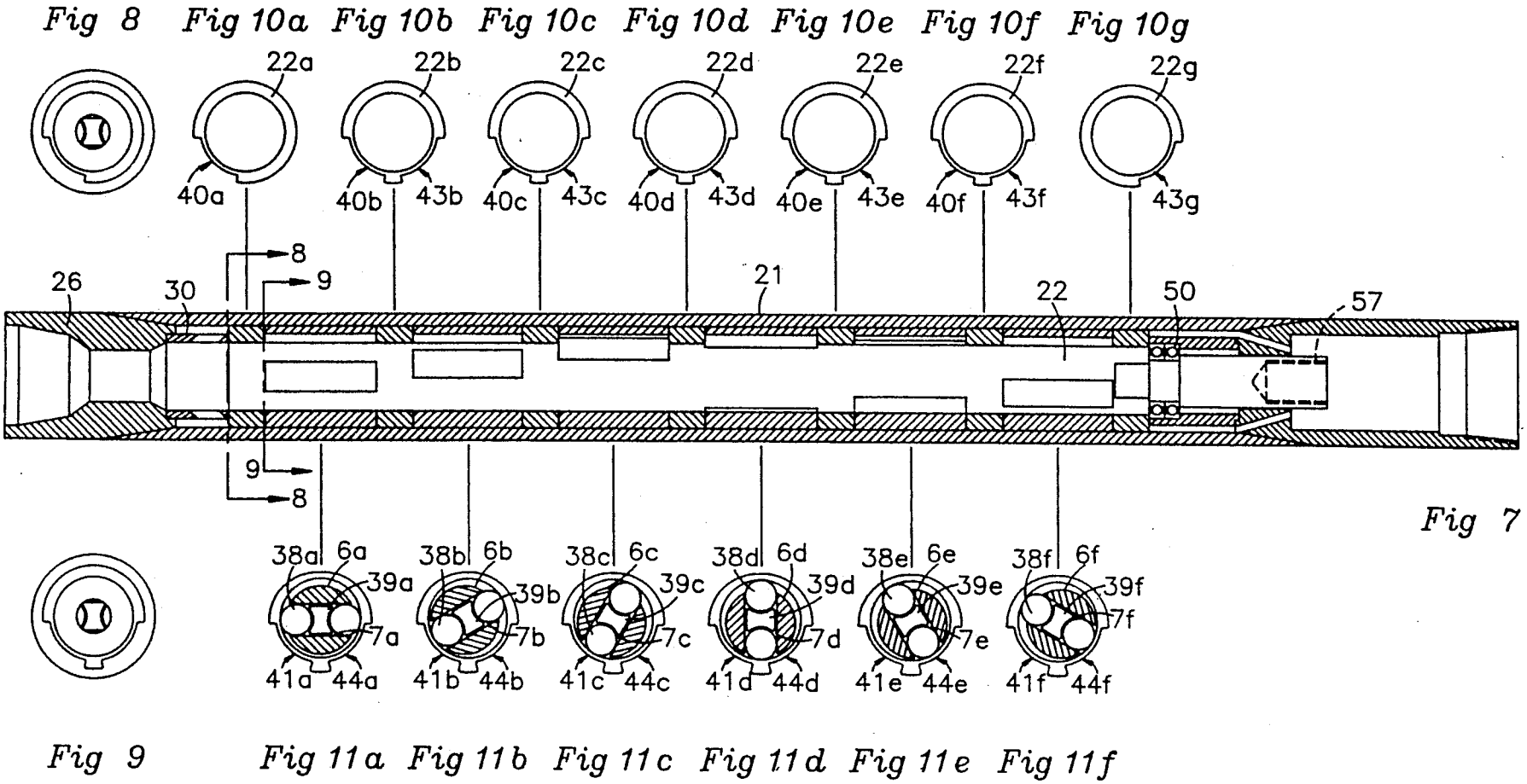
FIG. 7 is a part cut-away segmented side view of a six unit roller vane motor, fitted in a drill string, in accordance with yet another embodiment of the present invention, the units being powered in parallel.
FIG. 8 is a sectional view of the motor taken along the line VIII—VIII of FIG. 7.
FIG. 9 is a sectional view of one of the drive units taken along the line IX—IX of FIG. 7.
FIGS. 10*a* to 10*g* are sectional end views of the individual fluid connecting spacers defining each unit of the motor of FIG. 7.
FIGS. 11*a* to 11*f* are end views of the individual units respectively of the motor of FIG. 7.
Figure 14:
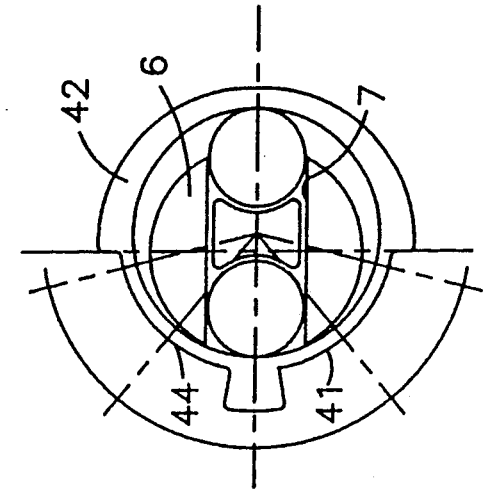
FIG. 14 is an end view to an enlarged scale of a unit with the rotor and rollers in place showing the floating roller spacer between the rollers.

FIG. 6 of the drawings shows a motor, contained within a cylindrical casing 14, which features two units 1*a* and 1*b* having a common rotor shaft 15. The rollers 8*a* and 8*b* of each unit 1*a* and 1*b* are offset by 180° such that at least one roller is being driven at all times whilst the motor is in operation.

Drive fluid is led from above the motor through a common inlet 18*a*, which drives units 1*a* and 1*b* alternately through 180°.

When the upper unit 1*a* is being driven, the high pressure fluid enters the unit 1*a* through the common inlet 18*a* which acts against the roller 8*a*, pushing this roller together with the rotor 15 through 180°. This in turn sweeps the low pressure fluid ahead of the roller through the outlet 5*a* where it is transferred across to the inlet 4*b* of the unit 1*b* below, via the cross over flow guide bush 28.

The low pressure fluid entering the unit 1*b* will be free to pass directly through the unit and exit via the outlet 5*b*, as the roller in this unit 1*b* is offset by 180° with respect to the unit 1*a*, thus causing the roller in this unit to be clear of the space between the inlet 4*b* and outlet 5*b*.

When the unit 1*b* is being driven, the roller 8*a* of upper unit 1*a* has completed its driven cycle of 180° and has just passed the outlet 5*a* and the roller 8*b* of the lower unit 1*b* has just passed the inlet port and is set to be driven through its 180° cycle.

The high pressure drive fluid still entering the common inlet 18*a* passes freely through the upper unit 1*a*, as there is no roller to oppose it. This high pressure fluid passes into the unit 1*a* at inlet 4*a*, flows freely around the roller chamber, and exits via the outlet 5*a*. At this point, the fluid is transferred across to the inlet 4*b* where it acts against the roller 8*b* of the lower unit 1*b*, driving it and the rotor 15 through 180°.

The lower pressure fluid ahead of the roller 8*b* of unit 1*b* is swept out of the outlet port 5*b* through a passageway 20*b* in the bush 20.

The rotor 15 has now been driven through 360° and the cycle is ready to start again.

FIGS. 7 to 15 of the drawings show a motor, which features six units 42*a* to 42*g* housing spacers 22*a* to 22*g*, located in a casing 21. In this example, the casing 21 is fixed in a drill string (not shown) by means of a top-sub 26, and bottom sub 27. The drive fluid is drilling mud which is pumped from surface, through the drill string to clean and cool the drill bit and to carry away the spoil.

The rotors 6*a* to 6*f* are formed on a common rotor shaft 22 and radial slots 7*a* to 7*f* are each offset by 30° to one another.

In this embodiment there is a pair of rollers 38*a* to 38*f* in each unit fitted into its common slot 7*a* to 7*f* respectively such that they are 180° opposed to each other and spaced by a respective hollow floating roller spacer 39*a* to 39*f* located between the rollers of each pair.

The drive fluid flows through the top sub 26 where it is free to enter the centre of the rotor 22 pressuring each pair of rollers through the floating spacers 39*a* to 39*f*.

Figure 13:
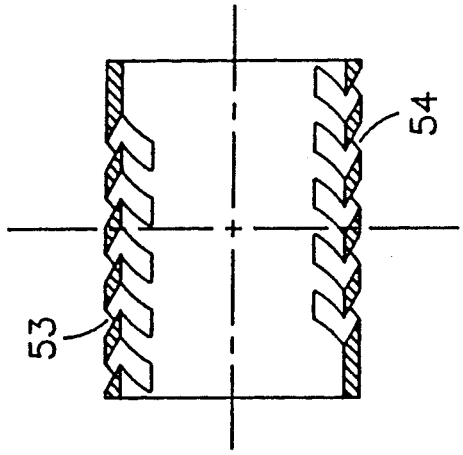
FIG. 13 is a section taken along the line XIII—XIII of FIG. 12.
Figure 12:
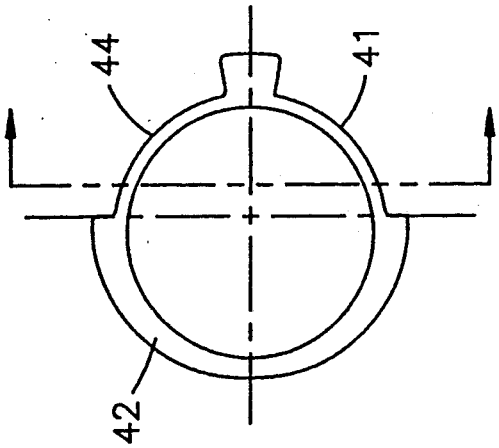
FIG. 12 is an end view to an enlarged scale of an intermediate fluid connecting spacer.

The main flow passes through a hold down bush 30 and down the gallery formed by high pressure feed slots 40*a* to 40*f* formed in the spacers 22*a* to 22*g* and high pressure feed slots 40*a* to 40*f* formed in the spacers 22*a* to 22*g* and high pressure feed slots 41*a* to 41*f* formed in the units 42*a* to 42*f* allowing high pressure fluid to enter the units 42*a* to 42*f* simultaneously via the inlet opening 53 shown in FIG. 13.

Thus the roller in each unit is driven through 180° pushing the fluid ahead of each roller out of outlet opening 54 (shown in FIG. 11) and into the gallery formed by the low pressure slots 43*b* to 43*g* and 44*a* to 44*f*. Then flowing out of the motor to be directed through a bearing pack so to the drill bit (not shown).

A small quantity of fluid being bled off for cooling and lubricating the bearings.

Each unit is fitted with two rollers each of which is driven through approximately 180°. The inlet and outlet ports are arranged such that as the first roller is just passing the end of the inlet the second has just passed the start of the outlet. Thus each units drives through 360°.

The rotors 6a to 6r are held in position in the casing 21 by the two slotted end spacers 22a and 22g and five slotted intermediate spacers 22b to 22f.

Below the end spacer 22g is the thrust bearing package 50 to support the end thrust of the rotor 22.

Figure 15:
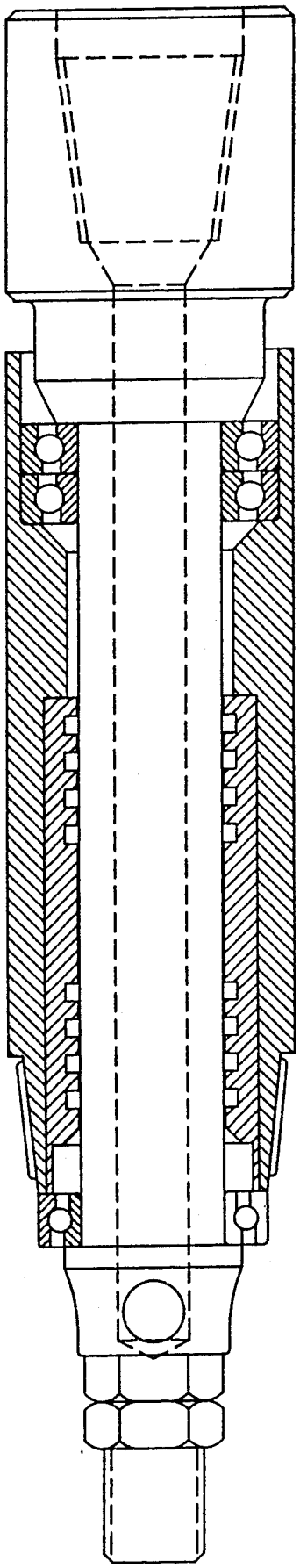
FIG. 15 is a sectional view of a bearing package connectable below the motor of FIG. 7 to support thrust and radial loads of the drive bit.

A simple ball thrust bearing is shown for clarity but in an actual working tool, more sophisticated packages would be used. In addition, a bearing package as shown in FIG. 15 has been attached below the motor to support bit radial and thrust loads. The splined shaft of the bearing engages the splined box 57 of the motor of FIG. 7.

This form of motor is simple and robust in construction and is therefore ideal for use in harsh environments such as downhole petroleum drilling applications where the power fluid is of an aggressive nature and where maintenance must be kept to a minimum.

The nozzle shown at the lower end of the rotor is to provide the restriction of fluid necessary to maintain pressure in the rotor for deployment of the rollers. In a drilling motor, this nozzle could be replaced by the drillbit nozzles and the flow requirements to the motor varied by the increase or reduction of this flow area.

Modifications and improvements may be incorporated without departing from the scope of the invention. For example, the rotor may be provided with a plurality of circumferentially spaced slots, each carrying its own roller to result in a multi-roller unit. Also, the motor may be used with compressible or non-compressible working fluids.

Accordingly, the motor may be used not only in a drilling environment as described above where the working fluid is drilling mud, but may be used with compressed air, sea water, pressurised hydraulic fluid or any other working fluid.

The design of the present invention may be adapted to operate as a pump by diverting pumped pressure fluid into the through passageway in the rotor thus providing the means for urging the rollers radially outwards.

Thus, there has been described a novel roller vane motor the roller being provided with a through passageway for conveying a portion of the driving fluid from the inlet to the outlet. Such an arrangement permits control of the speed/torque of the motor by suitably throttling the aperture at the outlet end. Also, the provision of the through bore in the rotor allows fluid to be conducted to the end of the rotor to provide a supply of power fluid at that point. A further advantage of the through passageway is that the bypass function provided by the through passageway acts to compensate for variations in chamber volume resulting from the reciprocating movement of the roller into and out of the slots in the rotor.

What is claimed is:

1. A roller vane motor comprising:

a stator;

a generally cylindrical chamber within the stator;

drive fluid inlet and outlet openings communicating with said chamber at respective ends thereof;

a rotor in the chamber being rotatable on an axis parallel to the axis of the chamber;

a slot formed in the rotor;

a roller disposed in the slot and rotatably movable to form a seal between the rotor and the housing, the axis of the roller being substantially parallel to the axes of the rotor and the chamber;

a biassing fluid path comprising biassing fluid inlet means communicating with a cavity formed in the slot to admit biassing fluid to said cavity to urge the roller in a direction to form said seal, and biassing fluid outlet means communicating with said cavity;

said biassing fluid inlet being adjacent said drive fluid inlet for communication of both said inlets with a common pressurised fluid;

said biassing fluid outlet being adjacent said drive fluid outlet for discharge to a common fluid conduit;

said biassing fluid path further comprising a restriction interposed between said cavity and said biassing fluid outlet and effective to maintain the fluid pressure in said cavity greater than the fluid pressure in said chamber.

2. A motor as claimed in claim 1, wherein said slot extends axially through the rotor and wherein two rollers are provided, said biassing fluid flowing between said rollers and within the slot.

3. A motor as claimed in claim 1, wherein the drive fluid inlet and outlet are in communication with respective side entry ports located along at least part of the chamber length on either side of the point of contact of the rotor and the chamber.

4. A motor assembly comprising a plurality of roller vane motors as claimed in claim 1.

5. A motor as claimed in claim 1, in which said restriction comprises an interchangeable nozzle adjacent said biassing fluid outlet, whereby a nozzle of a selected size may be fitted to the motor before use.

6. A downhole motor for use in a drill string having drilling mud passing therethrough, the motor comprising:

an elongate casing having means at either end for securement in a drill string, a plurality of n chambers formed in axial succession within the casing, each chamber being cylindrical with its axis parallel to but displaced from the longitudinal axis of the casing, a common rotor shaft extending through said chambers, a plurality of n rotors, each in a respective chamber, mounted on said rotor shaft, each rotor comprising at least one radial slot in which a roller is slidable into engagement with the wall of the respective chamber, said chambers and rotors being mutually angularly displaced relative to each other by 360/n degrees, the rotor shaft having a hollow interior to provide communication with the interior surfaces of said rollers, fluid inlet means at one end of the casing for receiving drilling mud from the drill string and passing said drilling mud to the interior of the rotor shaft and to an inlet to a first of the chambers, fluid outlet means at the other end of the casing for receiving drilling mud from an outlet of the last of the chambers and from the rotor shaft to discharge the drilling mud to the drill string, the chambers being interconnected for series passage of drilling mud therethrough, and the interior of the rotor shaft being provided with a restriction adjacent said fluid outlet means for producing a biassing pressure in said interior.

* * * * *